US006123153A

United States Patent [19]

Finnegan

[11] Patent Number: 6,123,153

[45] Date of Patent: Sep. 26, 2000

[54] FIRE PROTECTION SPRINKLE AND RELEASE MECHANISM

[75] Inventor: David M. Finnegan, Uxbridge, Mass.

[73] Assignee: Grinnell Corporation, Cranston, R.I.

[21] Appl. No.: 09/223,427

[22] Filed: Dec. 30, 1998

[51] Int. Cl.[7] ..... A62C 37/08

[52] U.S. Cl. ..... 169/37; 169/38; 169/39; 169/40; 169/41; 169/42; 169/56

[58] Field of Search ..... 169/37, 38, 39, 169/40, 41, 42, 56

[56] References Cited

U.S. PATENT DOCUMENTS

| | | | |
|---|---|---|---|
| 848,347 | 3/1907 | Cass | 169/39 |
| 3,633,676 | 1/1972 | Gloeckler | 169/40 |
| 3,812,915 | 5/1974 | Livingston | 169/38 |
| 4,015,665 | 4/1977 | Simons et al. | 169/40 |
| 4,105,076 | 8/1978 | Simons et al. | 169/40 |
| 4,664,198 | 5/1987 | Johnson | 169/38 |
| 4,800,961 | 1/1989 | Klein | 169/37 |
| 4,896,728 | 1/1990 | Wolff et al. | 169/38 X |
| 4,930,578 | 6/1990 | Barnett et al. | 169/39 |
| 4,976,320 | 12/1990 | Polan | 169/40 |
| 4,977,963 | 12/1990 | Simons | 169/37 |
| 5,083,616 | 1/1992 | Polan | 169/39 |
| 5,234,059 | 8/1993 | Eynon | 169/39 |
| 5,299,645 | 4/1994 | Hoening et al. | 169/39 |
| 5,494,114 | 2/1996 | Hoening et al. | 169/37 X |
| 5,810,263 | 9/1998 | Tramm | 239/518 |

OTHER PUBLICATIONS

Star Sprinkler; Product Data: Horizontal Institutional; Institutional Horizontal Sidewall Sprinkler; Model PH–5; 1–5.3.10; Rev. Jun. 1996 S2001–23.

Star Sprinkler; Product Data: Institutional Sprinkler: Institutional Sprinkler; Model PH–2; 1–5.2.10; Rev. Nov. 1990 S2001–21.

*Primary Examiner*—Andres Kashnikow
*Assistant Examiner*—Robin O. Evans
*Attorney, Agent, or Firm*—Fish & Richardson P.C.

[57] ABSTRACT

A fire protection sprinkler has a body with an orifice and a coaxial outlet for delivery of fire protection fluid from a source; a cap that resists flow of fluid from the outlet in a sprinkler standby condition; and an actuator securing the cap in the standby condition and releasing the cap in an operating condition to permit flow of fluid from the outlet. The actuator includes a thermally sensitive release assembly with an elongated thermally sensitive element, e.g. a frangible bulb, that breaks apart upon exposure to a predetermined elevated temperature range; opposed arms releasably positioning the frangible bulb with its axis transverse to the orifice axis; and a spring release member disposed substantially between the body and the thermally sensitive release assembly, the spring release member bearing against and applying force to the thermally sensitive release assembly transversely to the bulb axis, the spring release member being restrained in sprinkler standby condition by a combination to transverse and axially-directed compressive forces applied to the thermally sensitive release assembly by the opposed arms. Upon reaching the predetermined elevated temperature range, the bulb breaks apart to release the thermally sensitive release assembly from its sprinkler standby condition disposed substantially between the opposed arms, thereby releasing the spring release member to allow fire retardant fluid to flow from the outlet.

33 Claims, 5 Drawing Sheets

FIRE PROTECTION SPRINKLE AND RELEASE MECHANISM

This invention relates to thermally sensitive release mechanisms and fire protection sprinklers utilizing such release mechanisms.

BACKGROUND OF THE INVENTION

Automatic fire protection sprinklers generally include a body with a base, an inlet defined by the base and connectable to a source of fire retardant fluid under pressure, an outlet defined by the base, a passageway between the inlet and outlet, a flow-controlling orifice located generally just upstream of the outlet, a cap closing or sealing the outlet when the sprinkler is in its normal or standby state, a thermally sensitive mechanism which breaks apart and releases the sprinkler into its operating state when its temperature is elevated to within a pre-determined range, thereby allowing the pressurized fluid to move the cap away from its closed position and discharge from the outlet, and a deflector supported by arms or pins that extend from the base, in the sprinkler operating state, the deflector being positioned opposite the outlet for distribution of the fire protection fluid over a pre-selected region to be protected by the sprinkler from fire. Fire retardant fluid may include natural (potable) water, natural seawater, or selected mixtures of one or more additives with either type of water to enhance the fire fighting properties of the fire protection system. The cap may be separate from the deflector, may be separable from the deflector upon operation of the sprinkler, or may be fixed to the deflector. In one type of sprinkler, the deflector may be secured to arms that extend from the body to hold the deflector in a fixed position that is the same for both standby and operating states. In another embodiment, the arms or pins may be slidable within guide holes in the base portion, the deflector thereby being caused to move away from the outlet into its operating position upon release of the thermally sensitive mechanism.

Thermally sensitive release mechanisms, including those suitable for use in this invention, consist of a thermally sensitive element (e.g., a frangible bulb) which breaks apart when its temperature is elevated to within a prescribed operating temperature range, such as by heat from a fire, and a linkage mechanism that holds the cap closed when the sprinkler is in standby or closed condition, due to the interconnection between the cap and the thermally sensitive element. The cap is released upon breaking apart of the thermally sensitive element, and the fire protection fluid rushes from the outlet (e.g., initially downward for pendent-type fire sprinklers and initially horizontally for horizontal sidewall-type fire sprinklers). In the case of a pendent-type fire sprinkler, the fire protection fluid impacting the deflector is distributed downward and outward in a generally hemispherical pattern over the specified area to be protected from fire. In the case of a horizontal sidewall-type fire sprinkler, the fire protection fluid impacting the deflector is distributed downward and outward in a generally quarter-spherical pattern over the specified area to be protected from fire. The exact shape of the spray pattern for either type of sprinkler is, in large part, a function of the deflector configuration. However, in both cases, the character of the spray pattern can also be affected by any portion of the fire protection fluid impacting the deflector support arms or pins, either directly or after first striking the deflector. The character of the spray pattern can also be altered by any portion of the fire protection fluid impacting the cap, if it is fixed to the deflector and not thrown free upon operation of the sprinkler.

In addition to mounting orientation, a sprinkler is also categorized by the type of occupancy for which it is designed. Examples include: residential, commercial (e.g., mercantile), warehousing, and institutional, such as for correctional, detention, and mental health care facilities. So-called institutional sprinklers, e.g., including of this invention, have additional design requirements beyond those associated with conventional sprinklers used, e.g., in commercial and residential occupancies. For example, institutional sprinklers have a thermally sensitive release mechanism designed to be tamper resistant and to help reduce the opportunity for occupants to injure themselves or others, e.g., with components of the mechanism that might be broken away by tampering. In addition, it is an industry-accepted general design criteria that, in the standby state, in order to help prevent suicide, the thermally sensitive release mechanism should break away from the body of the sprinkler when a hanging load of 75 pounds or more is applied, e.g., by a cord, wire or the like.

In recent years, in situations where safety is a primary consideration in the selection of a fire protection sprinkler system for a particular occupancy, the use of quick response-type sprinklers has been increasingly specified. This is particularly true in the case of institutional occupancies, and the trend has been supported by revisions incorporated into the 1996 edition of the National Fire Protection Association's "Standard for Installation of Sprinkler Systems" ("NFPA 13"). The 1996 edition of NFPA 13 specifies that sprinklers in "Light Hazard" classification occupancies shall be of the quick response-type, and it also specifies that institutional occupancies are considered to fall within the "Light Hazard" classification. The need for quick response-type sprinklers in institutional occupancies has represented a particular challenge to sprinkler manufacturers. This is because the thermally sensitive elements in quick response-type sprinklers are generally more fragile, e.g. than those in standard response-type sprinklers, due, e.g., to the relatively smaller size and mass necessary to meet the rapidity of operation requirements of quick response-type sprinklers. However, as the surrounding structure provided to protect the thermally responsive element of an institutional sprinkler is increased, e.g., to better resist tampering, the restriction to flow of heated gases from a fire around the thermally responsive element, e.g. as necessary to raise its temperature to actuate the sprinkler, is generally increased, thereby hindering the rapidity of operation.

The use of frangible bulbs as thermally sensitive elements in automatic fire protection sprinklers has long been established. However, up until now, frangible glass bulbs in automatic fire protection sprinklers have been employed exclusively with application of opposing axial compression loads near their axial ends (commonly referred to as the "spherical" and "stem" or "pip" ends). Tramm U.S. Pat. No. 5,810,263 shows an example of an automatic fire protection sprinkler in which the frangible glass bulb is axially loaded between a compression screw engaging the spherical end of the bulb and a cap engaging the stem end of the bulb. Examples of automatic fire sprinklers with the frangible glass bulb axially loaded proximate to the spherical and stem ends, e.g. by a linkage mechanism holding the cap closed, are seen in Klein U.S. Pat. No. 4,800,961; Barnett et al. U.S. Pat. No. 4,930,578; Polan U.S. Pat. No. 4,976,320 and U.S. Pat. No. 5,083,616; Eynon U.S. Pat. No. 5,234,059; and Hoening et al. U.S. Pat. No. 5,299,645.

SUMMARY OF THE INVENTION

This invention relates to a new concept for utilizing frangible glass bulbs as the thermally sensitive element for automatic fire protection sprinklers intended for use in institutional occupancies and, specifically, but not limited to those of the quick response-type, wherein the thermally sensitive release mechanism can be designed to be compact, rugged, tamper resistant, and break apart when hanging loads of 75 pounds or more are applied. The improvement is obtained, in great part, as a result of application of a combination of transverse shear force and axially-directed compression force applied to the frangible bulb in the sprinkler standby or closed condition.

According to one aspect of the invention, a fire protection sprinkler comprises a body defining an orifice and an outlet for delivering a flow of fire protection fluid from a source, the orifice defining an orifice axis, and the outlet being disposed generally coaxial with the orifice axis; a cap positioned to resist flow of fire protection fluid from the outlet in the sprinkler standby or closed condition; and an actuator assembly securing the cap in the sprinkler standby or closed condition and releasing the cap in the sprinkler operating condition to permit flow of fire protection fluid from the outlet. The actuator assembly comprises a thermally sensitive release assembly or mechanism comprising an elongated thermally sensitive element adapted to break apart upon exposure to a predetermined elevated temperature range, the elongated thermally sensitive element defining a thermal element axis; opposed arm elements engaged with the sprinkler body in the sprinkler standby or closed condition that releasably position the thermally sensitive release assembly with the thermal element axis of the elongated thermally sensitive element generally transverse to the orifice axis; and a spring release member disposed substantially between the body and the thermally sensitive release assembly, the spring release member bearing against and applying force to the thermally sensitive release assembly in a direction transverse to the thermal element axis, the spring release member being restrained in the sprinkler standby or closed condition by a combination of transverse and axially-directed compressive forces applied to the thermally sensitive release assembly by the opposed arm elements. Upon reaching the predetermined elevated temperature range, the elongated thermally sensitive element breaks apart, releasing the thermally sensitive release assembly from its sprinkler standby condition substantially between the opposed arm elements, thereby releasing the spring release member to allow dislodging of the cap for flow of fire retardant fluid from the outlet.

Preferred embodiments of the invention may include one or more of the following additional features. The opposed arm elements comprise spring arm elements which position the thermally sensitive release assembly substantially therebetween by application of opposed compressive forces to the elongated thermally sensitive element along the thermal element axis. The thermally sensitive release assembly further comprises insert elements mounted at opposite ends of the elongated thermally sensitive element, restrained substantially between respective ends of the elongated thermally sensitive element and the associated opposed arm elements. Preferably, the insert elements are in releasable engagement with the elongated thermally sensitive element and the opposed arm elements, and the insert elements define cylindrical hub surfaces disposed in the sprinkler standby or closed condition for transverse engagement by the spring release member. The elongated thermally sensitive element comprises a frangible bulb. The insert elements define bores sized to releasably receive respective opposite ends of the frangible bulb. Preferably, the spring release member and/or the lever, in the sprinkler standby or closed condition, is releasably engaged by the body. More preferably, the body defines an annular lip extending generally about the outlet, and the lever and/or the spring release member, in the sprinkler standby or closed condition, is releasably engaged upon the annular lip. The actuator assembly securing the cap in the sprinkler standby or closed condition comprises a lever, the lever defining the opposed arm elements. The actuator assembly defines a protective enclosure for the elongated thermally sensitive element to resist tampering. Preferably, the protective enclosure defines apertures permitting flow of heated gases through the protective enclosure toward the elongated thermally sensitive element, and/or the protective enclosure defines baffling for directing flow of heated gases toward the elongated thermally sensitive element. Preferably, the protective enclosure is defined by the lever and by the spring release member. The actuator assembly releases from the body upon application of a predetermined maximum hanging load, preferably about 75 pounds. The fire protection sprinkler further comprises a deflector positioned in the sprinkler standby or closed condition generally between the outlet and the actuator assembly, and, in the sprinkler operating condition, the deflector is in a position spaced from and opposing the outlet, with fire protection fluid flowing from the outlet impinging upon the deflector and being distributed over a predetermined area to be protected from fire. The fire protection sprinkler is of a pendent-type, with the orifice axis oriented substantially vertically, or the fire protection sprinkler is of a horizontal sidewall-type, with the orifice axis oriented substantially horizontally, and for both types of sprinklers, the thermal element axis is oriented substantially horizontally. The force applied by the spring release member to the thermally sensitive release assembly in a direction transverse to the thermal element axis is at least about 9 pounds, and preferably at least about 12 pounds, and no more than about 30 pounds, and preferably no more than about 25 pounds. The opposed compressive force applied by the spring arm elements, and directed generally along the thermal element axis of the thermally sensitive release assembly, is at least about 9 pounds, and preferably at least about 12 pounds, and no more than about 30 pounds, and preferably no more than about 25 pounds.

According to another aspect of the invention, a fire protection sprinkler comprises a body defining an outlet for delivering a flow of fire protection fluid from a source, the outlet defining an outlet axis, a cap positioned to resist flow of fire protection fluid from the outlet in a sprinkler standby or closed condition; and an actuator assembly securing the cap in the sprinkler standby or closed condition in opposition to an ejection force, and releasing the cap in a sprinkler operating condition to permit flow of fire protection fluid from the outlet, the actuator assembly comprising a thermally sensitive release assembly comprising an elongated thermally sensitive element that breaks apart upon exposure to a predetermined elevated temperature range, the elongated thermally sensitive element defining a thermal element axis, and a release member disposed to bear against and apply the ejection force to the thermally sensitive release assembly in a direction transverse to the thermal element axis.

In preferred embodiments of this aspect of the invention, the fire protection sprinkler further comprises thermally sensitive release assembly positioning elements applying opposed compressive forces to the elongated thermally sensitive element, directed generally along the thermal element axis.

An objective of this invention is to provide an institutional sprinkler having a thermally sensitive release mechanism which meets the quick response-type sprinkler thermal sensitivity requirements of NFPA 13, yet is exceptionally compact, rugged, resistant to tampering, and which will break apart when hanging loads of 75 pounds or more are applied.

These and other features and advantages of the invention will be apparent from the following description of a presently preferred embodiment, and from the claims.

DETAILED DESCRIPTION

Figure 1:
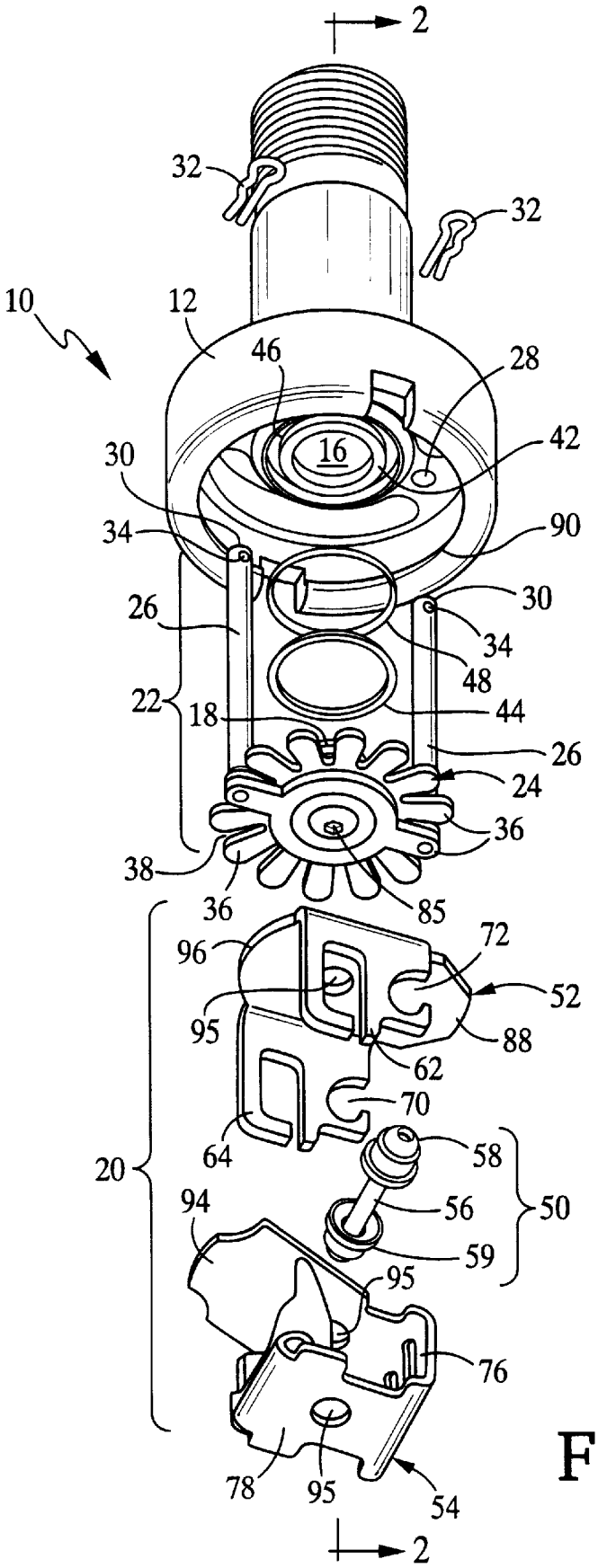
FIG. 1 is an exploded, perspective view of a fire protection sprinkler and release mechanism of the invention.
Figure 2:
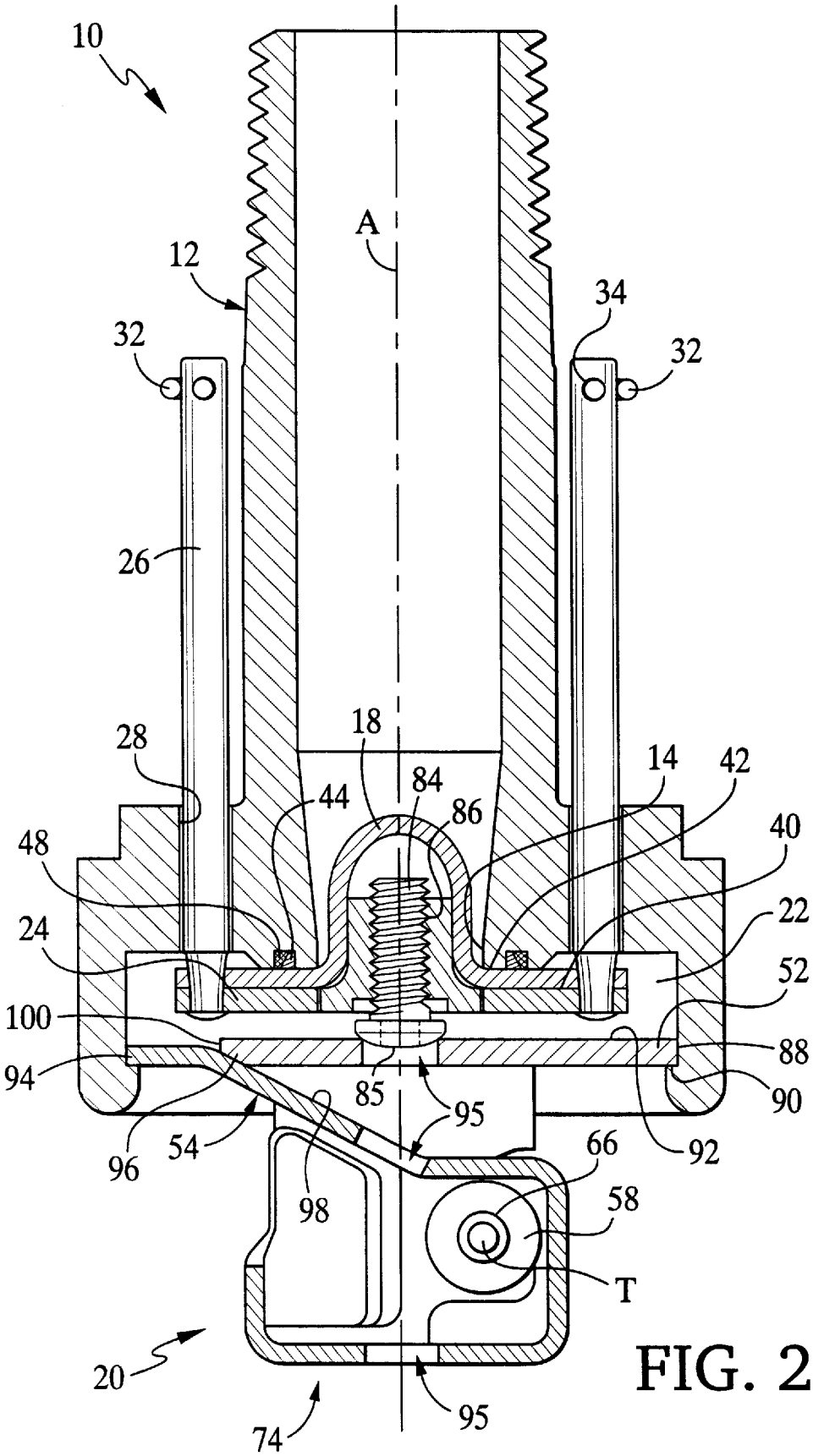
FIG. 2 is a side section view of the fire protection sprinkler and release mechanism FIG. 1 in assembled (i.e. sprinkler standby or closed) condition, taken generally along the line 2—2 of FIG. 1.
Figure 3:
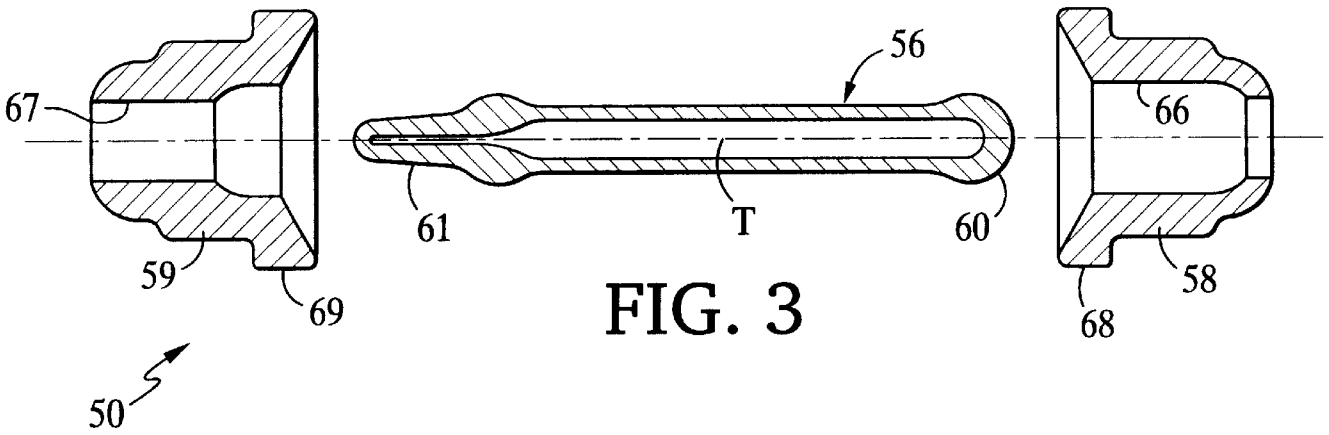
FIG. 3 is an exploded, side section view of a thermally sensitive release assembly including an elongated thermally sensitive element (a frangible bulb) and relief inserts of the fire protection sprinkler and release mechanism of FIG. 1.
Figure 5:
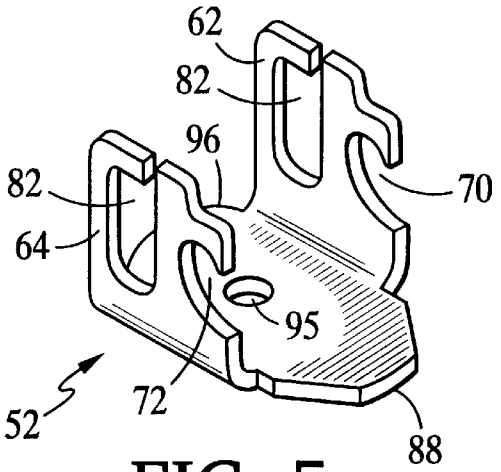
FIG. 5 is a perspective view of the lever with opposed arm elements of the fire protection sprinkler and release mechanism of FIG. 1.
Figure 4:
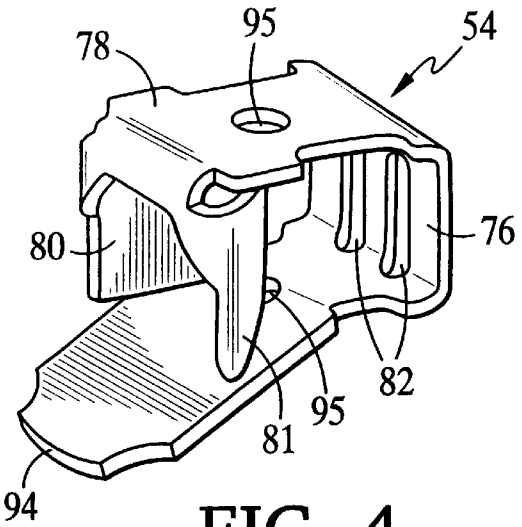
FIG. 4 is a perspective view of the spring release member of the fire protection sprinkler and release mechanism of FIG. 1.

Referring to the drawings, a fire protection sprinkler 10 has a body 12 defining an orifice 14 and an outlet 16 for delivering a flow of fire protection fluid from a source (not shown). The orifice defines an orifice axis, A, and the outlet is disposed generally coaxial with the orifice axis. A cap or plug 18 is positioned to resist flow of fire protection fluid from the outlet 16 when the sprinkler is in its standby or closed condition (FIG. 2). An actuator assembly 20 secures the cap 18 when the sprinkler is in its standby or closed condition and releases the cap when the sprinkler is in its operating condition (generally, FIG. 1) to permit flow of fire protection fluid from the outlet 16.

The fire protection sprinkler also includes a deflector assembly 22 with a deflector 24 which, in the standby or closed condition of the sprinkler (FIG. 2), is positioned generally between the outlet 16 and the actuator assembly 20. In the operating condition of the sprinkler, the deflector 24 is in a position spaced from and opposing the outlet, with fire protection fluid flowing from the outlet to impinge upon the deflector and be distributed over a predetermined area to be protected from fire. In the preferred embodiment, the sprinkler 10 has a drop-down deflector assembly 22 including the deflector 24 suspended from a pair of deflector rods or posts 26 disposed for sliding movement in guide bores 28, free ends 30 of the rods 26 secured by clips 32 in holes 34. The deflector 24 has tines 36 spaced about its periphery, with openings or spaces 38 therebetween. The number, spacing, and shape of the tines and openings are predetermined to achieve the desired distribution of water spray over the protected area. Also in the preferred embodiment, the cap or plug 18 is fixedly mounted to the surface 40 of the deflector 24 opposing the outlet 14. In the closed or standby condition of the sprinkler, the cap 18 is urged into sealing engagement upon the seat surface 42 surrounding the outlet 14, sealing being facilitated by an o-ring 44 retained in groove 46 by brass retainer ring 48.

The cap and deflector are urged into and retained in sealing engagement upon the seat by the actuator assembly 20, consisting generally of a thermally sensitive release assembly 50, a lever 52 and a spring release member 54.

The thermally sensitive release assembly 50 includes an elongated thermally sensitive element, adapted to break apart upon exposure to a predetermined elevated temperature range, and insert elements 58, 59 releasably mounted to opposite ends 60, 61 of the elongated thermally sensitive element. In this embodiment, the elongated thermally sensitive element is, e.g., a 2.5 mm frangible bulb 56 (such as available from Eduard Job, Kurt Fischer Strasse 30, Hamburg, Germany, a manufacturer of thermal responsive elements for use in fire protection sprinklers). The insert elements 58, 59, releasably mounted to the opposite ends 60, 61, of the frangible bulb 56, are engaged by the associated opposed arms 62, 64, respectively, of the lever 52. The frangible bulb 56 has a bulbous or spherical end 60 and an opposite, elongated stem or pip end 61. Preferably, the inserts 58, 59 define countersunk through bores 66, 67, respectively, sized and configured to releasably receive the respective, opposite ends 60, 61 of the frangible bulb 56. The inserts also define cylindrical hub surfaces 68, 69, respectively, disposed, in the sprinkler standby or closed condition, for transverse engagement by the spring release member 54. The elongated thermally sensitive element 56 defines a thermal element axis, T.

Once again, as discussed in detail above, it is important to note that a frangible bulb 56 configured for "quick-response" applications is typically mounted in a vertical orientation, with the spherical end 60 formed to engage and withstand forces applied by a compression screw. A quick-response bulb, upon reaching the predetermined elevated temperature range, advantageously fractures to activate the sprinkler more quickly than standard-response frangible bulbs. However, the quicker response characteristic requires a bulb that is relatively more fragile as compared to standard-response bulbs.

The lever 52, having opposed arms 62, 64, is releasably mounted to the sprinkler body 12. The arms 62, 64 define apertures 70, 72, respectively, for receiving the insert elements 58, 59 at opposite ends of the thermally sensitive release assembly 50 to releasably position the thermally sensitive release assembly with the thermal element axis, T, of the frangible bulb 56 positioned generally transverse to the orifice axis, A, in the standby or closed condition. Preferably, the opposed arms 62, 64 are spring arms which position the thermally sensitive release assembly 50 substantially therebetween by application of opposed axially-directed compressive forces (arrow C, FIG. 7) through inserts 58, 59 to the frangible bulb 56 along the thermal element axis, T.

The spring release member 54, supported by an annular lip 90 (defined by and inside the sprinkler body 12) and pushed outward by the lever 88, bears against and applies force to the thermally sensitive release assembly 50 (preferably upon the cylindrical hub surfaces 68, 69 of the inserts 58, 59) in a direction transverse to the axis, T, of the frangible bulb 56. The spring release member 54 is restrained in the sprinkler standby condition by a combination of transverse and axially-directed compressive forces applied to the thermally sensitive release assembly 50 engaged within the apertures 70, 72 of the opposed arms 62, 64, which prevents inserts 58, 59 from rotating out of the lever apertures 70, 72 due to the moment arm, M, shown schematically in FIG. 7.

The lever 52 and spring release member 54 together form a protective enclosure 74 for the frangible bulb, e.g. to resist tampering. However, to ensure proper performance in the case of fire, the protective enclosure 74 defines apertures permitting flow of heated gases from a fire through the protective enclosure toward the frangible bulb 56, and further defines baffling for directing flow of heated gases from a fire toward the frangible bulb 56. In particular, the spring release member 54 has a sidewall 76 and a top wall 78, which, together with opposed arms 62, 64 of lever 52, form box-like protective enclosure 74 around the frangible bulb 56. Spring release member 54 also has a pair of baffle walls 80, 81 extending downwardly from top wall 78, and inwardly toward the frangible bulb 56, for directing hot gases from a fire to flow toward the bulb. Side wall 76 of the spring release member 54 and the opposed arms 62, 64 of lever 52 also define openings 82 for flow of hot gases from a fire toward the frangible bulb 56. In the sprinkler standby or closed condition, the components of sprinkler 10 are well-confined and substantially free of projections.

Also, for institutional use, the actuator assembly 20 of the sprinkler 10 is constructed to release from the sprinkler body 12 upon application of a predetermined maximum hanging load, e.g. 75 pounds maximum is typical. The sprinkler 10 also has a relatively low profile, possible in large part due to horizontal mounting of the frangible bulb 56, which further reduces exposure of the components for tampering. The manner of assembling the components also makes removal of parts relatively more difficult, thus further to discourage tampering. The sprinkler 10 is thus particularly well-suited for use in detention and mental health care facilities, and in other institutions.

Figure 6:
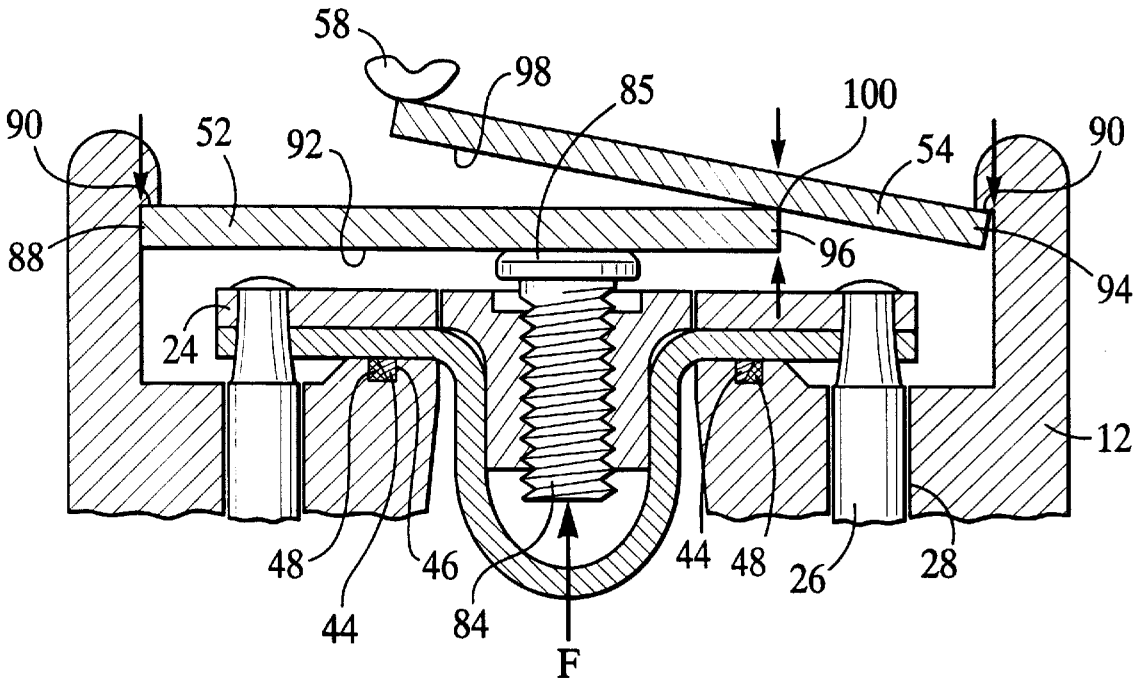
FIG. 6 is a schematic representation illustrating the forces acting on the spring release member and lever of the actuator assembly of the fire protection sprinkler and release mechanism of FIG. 1.
Figure 7:
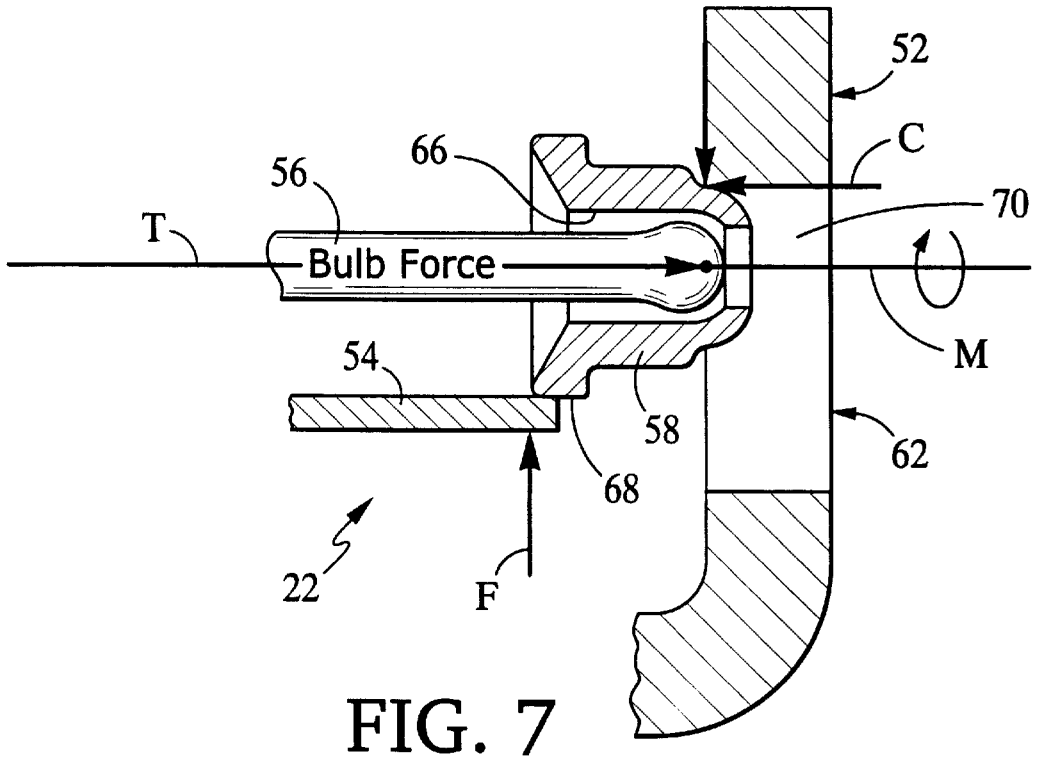
FIG. 7 is a schematic representation illustrating the forces acting on the relief inserts and frangible bulb of the thermally sensitive release assembly of the fire protection sprinkler and release mechanism of FIG. 1.

The fire protection sprinkler 10 is assembled by threading a compression screw 84 into threaded aperture 86 defined at the center of the deflector 24. The lever 52 is then positioned over deflector 24 with a first end 88 of the lever 52 releasably engaged beneath the annular lip 90 defined by the sprinkler body 12 and extending generally inward about the outlet 14, and the surface 92 of the lever 52 is engaged upon the screw head 85. A pair of inserts 58, 59 are mounted over the opposite ends 60, 61 of a frangible bulb 56, and then slid through the opening in the spring release member 54, between baffle walls 80, 81 and sidewall 76. The thermally sensitive release assembly 50 and spring release member 54 are then assembled with the lever 52 by engagement of the inserts 58, 59 within the respective slots or apertures 70, 72 defined by the opposed arms 62, 64 of the lever 52. (In the preferred embodiment, the thermally sensitive release assembly 50 engages between the arms 62, 64 with a slight interference fit, thus creating an axially-directed compressive force (arrow, C) upon the thermally sensitive release assembly 50 and thus on the frangible bulb 56.) The first end 94 of the spring release member 54 is engaged beneath the annular lip 90 defined by the sprinkler body 12, at a position diametrically opposed to the position of the first end 88 of the lever 52. An Allen wrench (or other suitable tool, not shown) is inserted through axially aligned openings 95 in spring release member 54 and lever 52 to access the screw head 85. Counter-clockwise rotation of the screw 84 to move the screw head 85 outwardly, towards the lever surface 92, causes the second or free end 96 of the lever 52 to engage the undersurface 98 of the release spring member 54 in loading engagement at a fulcrum 100, the degree of the load applied being adjusted by rotation of the screw 84 in threaded aperture 86. Referring to FIG. 6, the lever 52 and spring release member 54 act as a pair of opposing levered members, with screw head 85 and the lip 90 defining fulcrum points, the lever 52 and spring release member 54 thus define a pair of short levers providing a mechanical advantage of a magnitude similar to that of a single longer lever. The load applied by the screw head 85 to the lever 52, and communicated through the fulcrum 100 to the spring release member 54, is communicated by the spring release member 54 to the thermally sensitive release assembly 50, i.e. to the cylindrical hub surfaces 68, 69 of the inserts 58, 59, and then to the frangible bulb 56, by the engagement indicated by arrow, F. Referring to FIG. 7, the inserts 58, 59 also provide an additional mechanical advantage. In particular, the force applied by spring release member 54 to the inserts 58, 59 is conveyed to frangible bulb 56 as a relatively small load, with most of the load transferred to the lever 52 via the arms 62, 64. Thus, the inserts 58, 59 act to reduce the forces applied to the frangible bulb 56 to retain the spring release member 54 in the sprinkler in the standby or closed condition.

In operation of a fire protection sprinkler 10 of the invention in the case of a fire, upon reaching the predetermined elevated temperature range, the frangible bulb 56 breaks apart, allowing the inserts 58, 59 to rotate out of engagement with the apertures 70, 72, thus releasing the thermally sensitive release assembly 50 from between the opposed arms 62, 64. The spring release member 54 and lever 52 are thus released to disengage from the body 12. This, in turn, allows the cap 18 to be unseated from sealing engagement as pressure of the fire retardant fluid flowing from the outlet 14 forces the deflector 24 in a direction outwardly from the outlet 14, until clips 32 contact body 12. Fire protection fluid flowing from the outlet 14 impinges upon the deflector 24 to be distributed over a predetermined area to be protected from fire.

Other embodiments are within the following claims. For example, in the preferred embodiment described above, the thermally sensitive release assembly 50 is subjected to a combination of transversely-directed force (applied by the spring release member 54), e.g., in the preferred embodiment, a transversely-directed force of at least about 9 pounds, and preferably at least about 12 pounds, and of no more than about 30 pounds, and preferably no more than about 25 pounds, and axially-directed compressive force (applied by the opposed arms 62, 64), e.g., in the preferred embodiment, an axially-directed compressive force of at least about 9 pounds, and preferably at least about 12 pounds, and of no more than about 30 pounds, and preferably no more than about 25 pounds. Application of a combination of transverse and axially-directed compressive forces has been found to provide enhanced reliability and performance. However, in other embodiments of the invention, transverse force, with no or only a small axially-directed compressive force may be applied. For example, a predetermined spacing may be provided between the opposed arms 62, 64 and the length dimensions of the thermally sensitive release assembly 50 may be selected to provide engagement of the opposite ends of the assembly within apertures 70, 72 defined by the arms 62, 64 (to prevent inadvertent release and ensure transverse engagement of the assembly 50 with the arms 62, 64 when the spring release member 64 is engaged) but with little or no axial interference engagement of the thermally sensitive release assembly 50 with the arms 62, 64 (to avoid or provide only a small amount of axially-directed compressive force).

Figure 9:
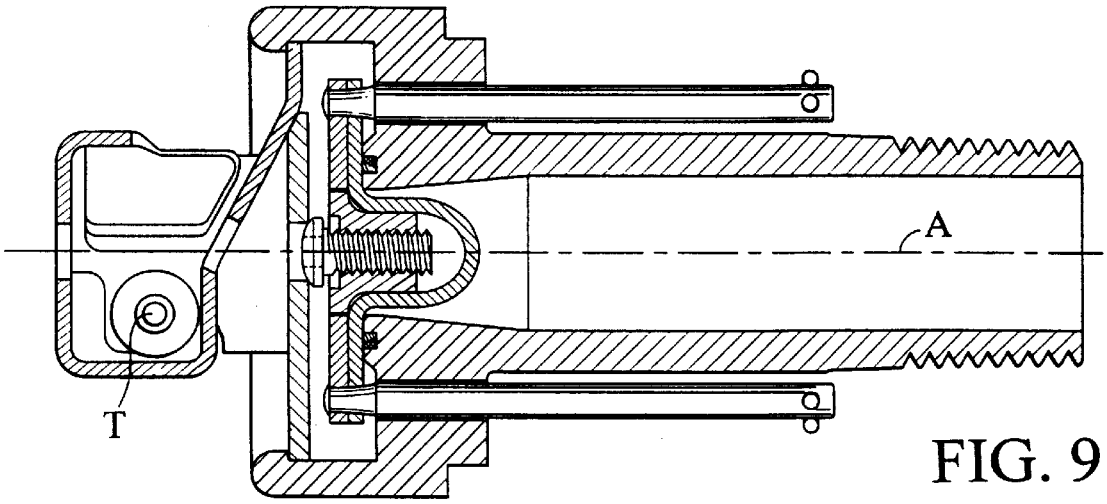
FIGS. 8 and 9 are side section views of the fire protection sprinkler and release mechanism of the invention in orientation as upright-type and horizontal sidewall-type sprinklers, respectively.
Figure 8:
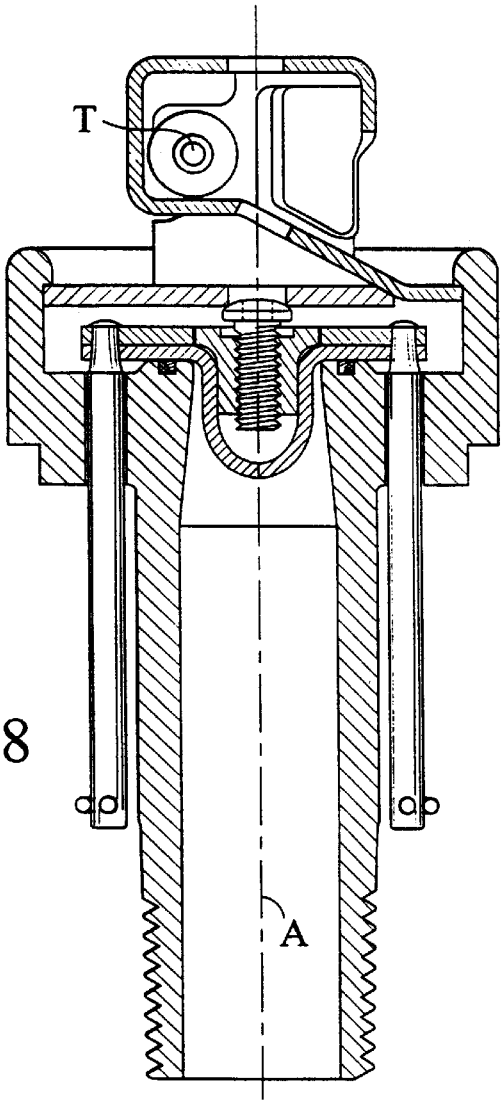

Also, fire protection sprinklers of the invention may, e.g., be of the pendent-type (e.g., as shown in FIG. 2), the upright-type, or the horizontal sidewall-type (e.g., as shown in FIGS. 8 and 9, respectively). In pendent-type and upright-type sprinklers, including those of the invention, the orifice axis is oriented generally vertically. In horizontal sidewall-type sprinklers, including those of the invention, the orifice axis is oriented generally horizontally. In pendent-type, upright-type and horizontal sidewall-type sprinklers of the invention, the thermal element axis is oriented generally horizontally. Other embodiments of this invention may also include thermally activated fire protection control valves within the scope of the claims.

The thermally sensitive element may have any thermal response characteristic, such as, e.g., what is referred to in the art as standard response, special response, or quick response, with a frangible bulb diameter selected to suit the response type requirements. In addition, the thermally sensitive release element or assembly may be of the fusible solder type.

What is claimed is:

1. A fire protection sprinkler comprising:

a body defining an orifice and an outlet for delivering a flow of fire protection fluid from a source, said orifice defining an orifice axis, and said outlet being disposed generally coaxial with said orifice axis;

a cap positioned to resist flow of fire protection fluid from said outlet in a sprinkler standby or closed condition; and an actuator assembly securing said cap in the sprinkler standby or closed condition and releasing said cap in a sprinkler operating condition to permit flow of fire protection fluid from said outlet, said actuator assembly comprising:

a thermally sensitive release assembly comprising an elongated thermally sensitive element adapted to break apart upon exposure to a predetermined elevated temperature range, said elongated thermally sensitive element defining a thermal element axis;

opposed arm elements engaged with said sprinkler body in said sprinkler standby or closed condition and releasably positioning said thermally sensitive release assembly with said thermal element axis of said elongated thermally sensitive element generally transverse to said orifice axis;

a spring release member disposed between said body and said thermally sensitive release assembly, said spring release member bearing against and applying spring member release loading force to said thermally sensitive release assembly in a direction transverse to said thermal element axis, said spring release member being restrained in said sprinkler standby or closed condition by a combination of transverse and axially-directed compressive forces applied to said thermally sensitive release assembly by said opposed arm elements; and a spring release member loading adjustment element engaged with said spring release member and adapted to be moved to adjust said spring member release loading force applied to said thermally sensitive release assembly in a direction transverse to said thermal element axis, and adapted to be moved without varying compressive forces on said elongated thermally sensitive release element in a direction generally along said thermal element axis;

whereby, upon reaching said predetermined elevated temperature range, said elongated thermally sensitive element breaks apart, releasing said thermally sensitive release assembly from said sprinkler standby or closed condition disposed substantially between said opposed arm elements, thereby releasing said spring release member to allow dislodging of said cap for flow of fire retardant fluid from said outlet.

2. The fire protection sprinkler of claim 1, wherein said opposed arm elements comprise spring arm elements which position said thermally sensitive release assembly substantially therebetween by application of opposed compressive forces to said elongated thermally sensitive element in a direction generally along said thermal element axis.

3. The fire protection sprinkler of claim 1, wherein said thermally sensitive release assembly further comprises insert elements mounted at opposite ends of said elongated thermally sensitive element, restrained substantially between respective ends of said elongated thermally sensitive element and associated said opposed arm elements.

4. The fire protection sprinkler of claim 3, wherein said opposed arm elements define apertures for receiving said insert elements.

5. The fire protection sprinkler of claim 3 or 4, wherein said insert elements are in releasable engagement with said elongated thermally sensitive element and said opposed arm elements.

6. The fire protection sprinkler of claim 3 or 4, wherein said insert elements define cylindrical hub surfaces disposed in said sprinkler standby or closed condition for transverse engagement by said spring release member.

7. The fire protection sprinkler of claim 3, wherein said elongated thermally sensitive element comprises a frangible bulb.

8. The fire protection sprinkler of claim 7, wherein said insert elements define bores sized to releasably receive respective opposite ends of said frangible bulb.

9. The fire protection sprinkler of claim 1, wherein said release spring member, in said sprinkler standby or closed condition, is releasably engaged by said body.

10. The fire protection sprinkler of claim 9, wherein said body defines an annular lip extending about said outlet, and said release spring member, in said sprinkler standby or closed condition, is releasably engaged upon said annular lip.

11. The fire protection sprinkler of claim 1 or 9, wherein said actuator assembly securing said cap in said sprinkler standby or closed condition comprises a lever, said lever defining said opposed arm elements.

12. The fire protection sprinkler of claim 11, wherein said lever, in said sprinkler standby or closed condition, is releasably engaged by said body.

13. The fire protection sprinkler of claim 12, wherein said body defines an annular lip extending generally about said outlet, and said lever, in said sprinkler standby or closed condition, is releasably engaged upon said annular lip.

14. The fire protection sprinkler of claim 1, wherein said actuator assembly defines a protective enclosure for said elongated thermally sensitive element to resist tampering.

15. The fire protection sprinkler of claim 14, wherein said protective enclosure defines apertures permitting flow of heated gases through said protective enclosure toward said elongated thermally sensitive element.

16. The fire protection sprinkler of claim 14 or 15, wherein said protective enclosure defines baffling for directing flow of heated gases toward said elongated thermally sensitive element.

17. The fire protection sprinkler of claim 14, wherein said protective enclosure is defined by said lever and by said spring release member.

18. The fire protection sprinkler of claim 14, wherein said actuator assembly releases from said body upon application of a predetermined maximum hanging load.

19. The fire protection sprinkler of claim 18, wherein said predetermined maximum hanging load is about 75 pounds.

20. The fire protection sprinkler of claim 1, further comprising a deflector positioned in said sprinkler standby or closed condition generally between said outlet and said actuator assembly, and, in said sprinkler operating condition, said deflector being in a position spaced from and opposing said outlet, with fire protection fluid flowing from said outlet impinging upon said deflector and being distributed over a predetermined area to be protected from fire.

21. The fire protection sprinkler of claim 1, wherein said fire protection sprinkler is of a pendent-type, with said orifice axis oriented substantially vertically and said thermal element axis oriented substantially horizontally.

22. The fire protection sprinkler of claim 1, wherein said fire protection sprinkler is of a horizontal sidewall-type, with said orifice axis oriented substantially horizontally and said thermal element axis oriented substantially horizontally.

23. The fire protection sprinkler of claim 1, wherein the force applied by said spring release member to said thermally sensitive release assembly in a direction transverse to said thermal element axis is at least about 9 pounds.

24. The fire protection sprinkler of claim 23, wherein the force applied by said spring release member to said thermally sensitive release assembly in a direction transverse to said thermal element axis is at least about 12 pounds.

25. The fire protection sprinkler of claim 1 or 23, wherein the force applied by said spring release member to said thermally sensitive release assembly in a direction transverse to said thermal element axis is no more than about 30 pounds.

26. The fire protection sprinkler of claim 25, wherein the force applied by said spring release member to said thermally sensitive release assembly in a direction transverse to said thermal element axis is no more than about 25 pounds.

27. The fire protection sprinkler of claim 2, wherein the opposed compressive force applied by said spring arm elements, directed generally along said thermal element axis of said thermally sensitive release assembly, is at least about 9 pounds.

28. The fire protection sprinkler of claim 27, wherein the opposed compressive force applied by said spring arm elements, directed generally along said thermal element axis of said thermally sensitive release assembly, is at least about 12 pounds.

29. The fire protection sprinkler of claim 2 or 27, wherein the opposed compressive force applied by said spring arm elements, directed generally along said thermal element axis of said thermally sensitive release assembly, is no more than about 30 pounds.

30. The fire protection sprinkler of claim 29, wherein the opposed compressive force applied by said spring arm elements, directed generally along said thermal element axis of said thermally sensitive release assembly, is no more than about 25 pounds.

31. The fire protection sprinkler of claim 1 or 2, wherein said elongated thermally sensitive element comprises a frangible bulb.

32. A fire protection sprinkler comprising:

a body defining an outlet for delivering a flow of fire protection fluid from a source, said outlet defining an outlet axis;

a cap positioned to resist flow of fire protection fluid from said outlet in a sprinkler standby or closed condition; and an actuator assembly securing said cap in the sprinkler standby or closed condition in opposition to an ejection force, and releasing said cap in a sprinkler operating condition to permit flow of fire protection fluid from said outlet, said actuator assembly comprising:

a thermally sensitive release assembly comprising an elongated thermally sensitive element adapted to break apart upon exposure to a predetermined elevated temperature range, said elongated thermally sensitive element defining a thermal element axis;

a release member disposed to bear against and apply said ejection force to said thermally sensitive release assembly in a direction transverse to said thermal element axis; and a release member loading adjustment element engaged with said release member and adapted to be moved to adjust said ejection force applied to said thermally sensitive release assembly in a direction transverse to said thermal element axis, and adapted to be moved without varying compression forces on said elongated thermally sensitive release element in a direction generally along said thermal element axis.

33. The fire protection sprinkler of claim 32, said actuator assembly further comprising thermally sensitive release assembly positioning elements applying opposed compressive forces to said elongated thermally sensitive element, directed generally along said thermal element axis.

* * * * *